US007465145B2

(12) United States Patent
Kane

(10) Patent No.: US 7,465,145 B2
(45) Date of Patent: Dec. 16, 2008

(54) TIP CLEARANCE CONTROL SYSTEM

(75) Inventor: Daniel E. Kane, Tolland, CT (US)

(73) Assignee: United Technologies Corporation, Hartford, CT (US)

( * ) Notice: Subject to any disclaimer, the term of this patent is extended or adjusted under 35 U.S.C. 154(b) by 672 days.

(21) Appl. No.: 11/082,575

(22) Filed: Mar. 17, 2005

(65) Prior Publication Data

US 2008/0206039 A1 Aug. 28, 2008

(51) Int. Cl.
*F01D 11/16* (2006.01)

(52) U.S. Cl. ..... 415/1; 415/26; 415/47; 415/118; 415/173.1; 415/173.2; 415/176; 415/178; 60/782; 60/785; 701/100

(58) Field of Classification Search ..... 415/1, 415/14, 17, 26, 28, 47, 118, 173.1, 173.2, 415/173.3, 175–178; 60/782, 785; 73/1.79, 73/116, 119 R, 1.81, 168, 112.01, 112.06, 73/116.03; 701/29, 100

See application file for complete search history.

(56) References Cited

U.S. PATENT DOCUMENTS 4,248,042 A * 2/1981 Larsen et al. ..... 60/243
4,257,222 A 3/1981 Schwarz
4,330,234 A 5/1982 Colley
4,999,991 A 3/1991 Haddad et al.
5,005,352 A 4/1991 Schwarz et al.
5,012,420 A 4/1991 Walker et al.
5,072,580 A * 12/1991 Patterson et al. ..... 60/242
5,915,917 A 6/1999 Eveker et al.
6,155,038 A 12/2000 Irwin et al.
6,231,306 B1 5/2001 Khalid
6,272,422 B2 8/2001 Khalid et al.
6,607,350 B2 8/2003 Dodd
6,626,635 B1 9/2003 Prowse et al.
6,715,984 B2 4/2004 Nakajima et al.

* cited by examiner

*Primary Examiner*—Christopher Verdier
(74) *Attorney, Agent, or Firm*—Kenneth C. Baran; Colin L. Cini

(57) ABSTRACT

The invention is a method for controlling blade tip clearance in a turbine engine having a flowpath extending therethrough, and a system for carrying out the method. The method includes acquiring a first nonpulsating pressure signal $P_C$ representative of tip clearance, sensing a second pressure $P_B$ substantially unaffected by tip clearance, forming an actual ratio of the acquired pressure and the sensed pressure, determining an error E having an actual component and a desired component, the actual component being a function of the actual ratio; and commanding a clearance control system to reduce the error.

7 Claims, 2 Drawing Sheets

TIP CLEARANCE CONTROL SYSTEM

TECHNICAL FIELD

This invention relates to systems for controlling blade tip clearances in turbine engines.

BACKGROUND OF THE INVENTION

Turbine engines, such as those used to power commercial and military aircraft, include a turbine module comprising a bladed turbine circumscribed by a case. The turbine includes a hub, which is rotatable about an engine axis, and a set of blades projecting radially from the hub. The blades span across a working medium flowpath so that the tips of the blades are separated from the case by a small clearance gap.

The size of the clearance gap can change during engine operation because the hub and blades respond to centrifugal force arising from rotation of the hub whereas the case does not. In addition, the hub, blades and case all respond to temperature changes but at different rates. Despite these differences in mechanical and thermal response, it is nevertheless important to control the size of the clearance gap. If the gap is too small, a rapid acceleration of the engine could cause the blade tips to contact the case, resulting in damage to the blades or case. If the gap is too large, the efficiency of the turbine suffers.

Engine designers have devised various ways to control tip clearance. A well known arrangement uses cooling air ducts circumscribing the engine case. The ducts are radially offset from the case leaving an annular space between the duct and the case. A modulating valve commanded by a controller regulates the admission of relatively cool air into the duct. Coolant outlet holes penetrate the radially inner side of the duct. When the controller commands the valve to a fully or partially open position, cool air enters the ducts, discharges through the outlet holes and impinges on the case. This cools the case, causing it to contract radially toward the blade tips, the amount of contraction being related to the temperature and quantity of cool air admitted to the duct by the valve. When the controller commands the valve to close, the flow of cool air ceases, allowing the case to expand radially away from the blade tips. In order to achieve the desired tip clearances the designer establishes one or more control "schedules" that the controller uses to command the position of the valve as a function of engine operating conditions such as flight condition (e.g. altitude and airspeed) and engine power setting.

One shortcoming of the above described system is that the designer must make estimates of the amount of cooling air required at a variety of operating conditions. In doing so, the designer must account for the inevitable inaccuracies in these estimates. In addition, the controller must work on all engines on which it might be installed, irrespective of manufacturing variations and differing rates of deterioration of the individual members of an engine family. As a result, most engines will operate at non-optimum tip clearance most of the time. Typically, the designer intentionally errs in the direction of having tip clearances that are too large rather than too small. This is because excessively small clearances can, under some conditions, result in the blade tips contacting the case and causing damage, whereas excessively large clearances merely result in poor efficiency.

One other way to control tip clearances is to program the controller with a mathematical model of the engine so that the controller can continually estimate the existing tip clearance as a function of engine operating condition. This allows the designer to use a closed loop controller that minimizes the error between the estimated clearance and a desired clearance. However the mathematical model can also suffer from inaccuracies that lead the designer to err in the direction of excessively large clearance. In addition, the model imposes additional computational demands on the controller.

Another system is described in U.S. Pat. No. 4,330,234 which shows a probe with an open end exposed to a turbine flowpath at a location radially outboard of a row of blades. The probe is connected to a supply of pressurized air. Each time a blade passes the probe, the pressure in the probe is affected depending on the smallness of the blade tip clearance. The effect sensed by the probe is apparently an intermittent pressure pulse superimposed on the pressure of the supplied air. The patent does not reveal the relationship between the magnitude of the pulse and the tip clearance, nor how the fidelity of that relationship might be affected by changes in flight condition, engine power setting and probe supply pressure. Despite the presumed merits of the disclosed system, it clearly adds weight, cost and complexity to the engine. Moreover, if the pressurized air fed to the probe is extracted from elsewhere in the engine, the engine will experience a loss of efficiency, not unlike the efficiency loss that the clearance control system seeks to remedy.

SUMMARY OF THE INVENTION

What is needed is a clearance control system that allows accurate, reliable and repeatable control of tip clearance irrespective of engine operating conditions.

According to one embodiment of the invention, a method for controlling blade tip clearance in a turbine engine includes acquiring a nonpulsating pressure signal representative of tip clearance, sensing another pressure substantially unaffected by tip clearance, forming an actual ratio of the acquired pressure and the sensed pressure, determining an error having an actual component and a desired component, the actual component being a function of the actual ratio, and commanding the relevant components of a clearance control system to reduce the error.

The foregoing and other features of the various embodiments of the invention will become more apparent from the following description of the best mode for carrying out the invention and the accompanying drawings.

BEST MODE FOR CARRYING OUT THE INVENTION

Figure 1:
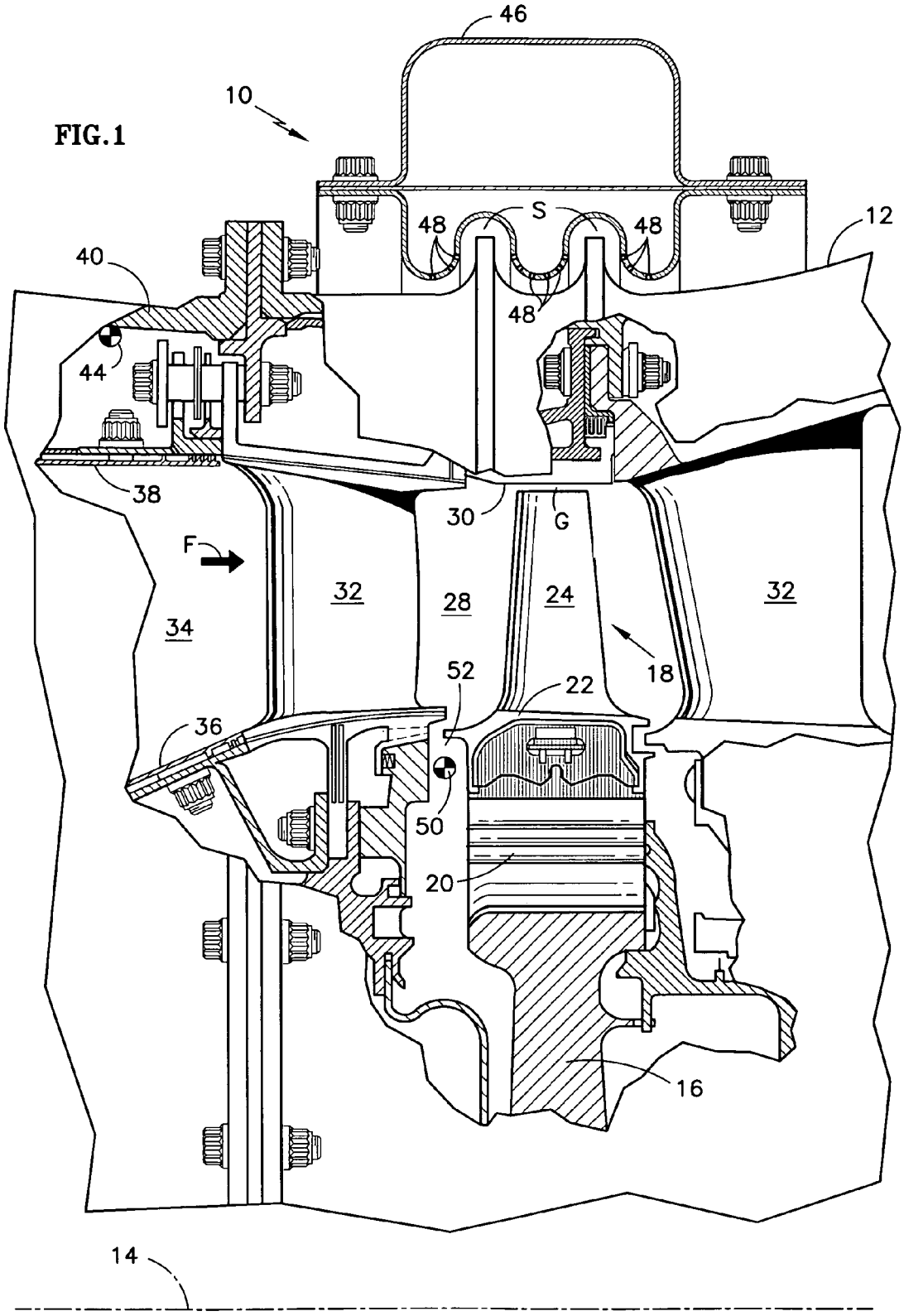
FIG. 1 is a cross sectional side elevation view of a turbine module of an aircraft gas turbine engine.

FIG. 1 shows a turbine module 10 of a modern aircraft gas turbine engine. The turbine module includes a turbine case 12 circumscribing an engine axis 14 and a turbine hub 16 rotatable about the axis. A set of blades 18 projects radially from the hub. Each blade includes a root 20 anchored in the blade bub, a platform 22 and an airfoil 24. The blade platforms cooperate with each other to define a radially inner boundary of a working medium flowpath 28. A shroud 30, which may be considered part of the case 12 defines the radially outer boundary of the flowpath. The airfoils 24 span across the flowpath 28 so that their tips are separated from the case by a small clearance gap G. A set of nonrotatable stator vanes 32 spans across the flowpath axially forward of the blades. During engine operation, a stream of working medium fluid F flows through the flowpath.

A combustor or burner 34, only the aft end of which is illustrated, resides axially forward of the turbine module. The burner includes radially inner and outer liners 36, 38 both circumscribed by a burner case 40. A sensor 44, such as a static pressure probe, senses the pressure in the annular space between the outer liner and the burner case. This pressure is referred to as burner pressure or $P_B$. The magnitude of the burner pressure is affected by certain aspects of the engine operating condition, such as altitude and engine power setting, but is unaffected by the size of the tip clearance gap G.

A clearance control air duct 46, which is part of a turbine clearance control system, circumscribes the engine case 12. The duct is radially offset from the case leaving an annular serpentine space S between the duct and the case. Coolant outlet holes 48 penetrate the radially inner side of the duct. A modulating valve and a controller, not shown, regulate admission of relatively cool air into the duct. The cool air discharges from the holes 48 and impinges on the case to control the size of the gap G as previously described.

A sensor, for example a static pressure probe 50, acquires a pressure signal in a cavity 52 radially inboard of the blade platforms and therefore radially inboard of the flowpath. This pressure is referred to as cavity pressure or $P_C$. Because the cavity is in fluid communication with the turbine flowpath, the cavity pressure $P_C$ equals the pressure $P_T$ sin the turbine flowpath, or differs from $P_T$ by a predictable, repeatable amount. And because $P_T$ changes as the clearance gap G changes, $P_C$ is representative of the size of the gap G. But, because the pressure $P_C$ is measured outside the flowpath, it is a nonpulsating pressure substantially unperturbed by pulsations arising from blade tips sweeping past a given point. Moreover, the pressure $P_C$ is unaffected by other localized flowpath influences that might corrupt a pressure signal acquired from the gas path, which would make the signal unsatisfactory as an indicator of clearance gap. These influences include wakes and eddies in the working medium fluid stream flowing through the flowpath.

Figure 2:
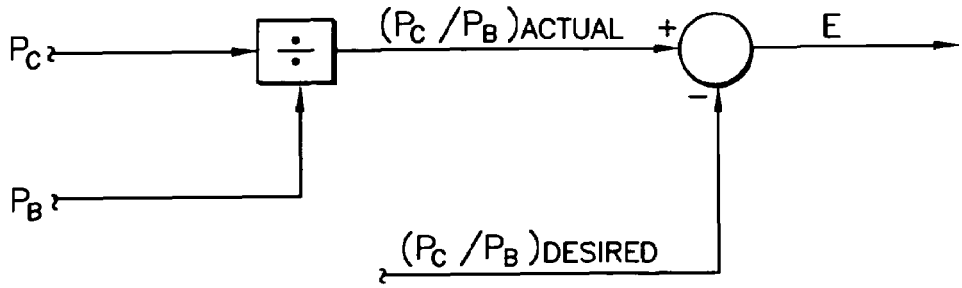
FIG. 2 is a block diagram of a controller for managing tip clearances in the turbine of FIG. 1.

FIG. 2 is a controller block diagram corresponding to the present invention. The method of the invention includes acquiring a nonpulsating pressure signal, such as $P_C$, which is representative of tip clearance G. The method also includes sensing a pressure such as $P_B$, which is substantially unaffected by tip clearance G. The controller forms the actual ratio $(P_C/P_B)_{ACTUAL}$ of the acquired pressure to the sensed pressure. It is desirable to normalize $P_C$ by dividing it by $P_B$ rather than use an un-normalized value of $P_C$. Using an un-normalized value of $P_C$ would make it difficult to distinguish between the effects of altitude, engine power and clearance gap. The normalized value $(P_C/P_B)_{ACTUAL}$ effectively filters out the effects of altitude and engine power.

The controller also uses a desired value of the ratio of the acquired and sensed pressure (in this case cavity pressure and burner pressure) shown as $(P_C/P_B)_{DESIRED}$. Typically the desired ratio would be programmed into an electronic controller as a function of engine operating condition and power setting. The desired ratio might also be made a function, at least in part, of recent transient influences imposed on the engine, such as sudden changes in altitude, airspeed or engine power setting.

The controller determines an error E having an actual component and a desired component. The actual component is a function of the actual ratio, $(P_C/P_B)_{ACTUAL}$ and, in the controller diagram of FIG. 2, is equal to the actual ratio $(P_C/P_B)_{ACTUAL}$. The desired component is the desired ratio, $(P_C/P_B)_{DESIRED}$. The controller issues commands to the clearance control system hardware, for example to the valve that regulates admission of cool air to the duct 46, to reduce the error.

Figure 3:
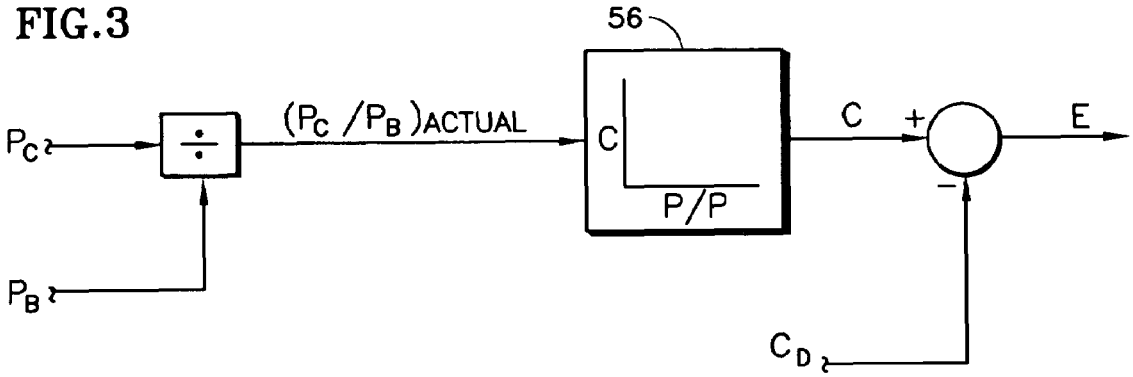
FIG. 3 is a block diagram of an alternate controller for managing tip clearances in the turbine of FIG. 1.

It will be appreciated that because $P_C$ is representative of the tip clearance gap, the above described system controls blade tip clearance, not just cavity pressure. In another embodiment shown in FIG. 3, the actual ratio $(P_C/P_B)_{ACTUAL}$ is used to make an estimate C of the actual tip clearance G. Such an estimate might be made with a look-up table 56 coded into the memory of the electronic controller. Therefore, in FIG. 3, the actual component of the error is a clearance C determined as a function of the actual ratio $(P_C/P_B)_{ACTUAL}$. The desired value of the clearance is $C_D$. Typically the desired clearance would be programmed into the controller as a function of engine operating condition and power setting. The desired clearance might also be made a function, at least in part, of recent transient influences imposed on the engine, such as sudden changes in altitude, airspeed or engine power setting.

Figure 4:
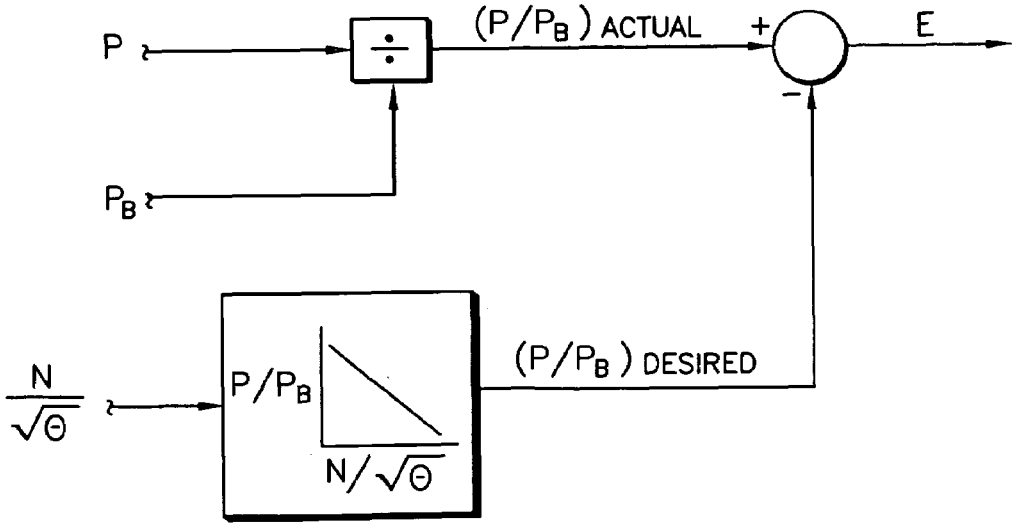
FIG. 4 is a block diagram similar to that of FIG. 1 but adapted for controlling blade tip clearances in a compressor.

FIG. 4 shows how the invention can be used to control compressor blade tip clearances in a turbine engine. The method includes acquiring a nonpulsating pressure signal, such as P, which is representative of compressor blade tip clearance, and sensing a pressure such as burner pressure $P_B$, which is substantially unaffected by compressor blade tip clearance. The controller forms the actual ratio $(P/P_B)_{ACTUAL}$ of the acquired pressure to the sensed pressure. The controller also uses a desired value of the ratio of the acquired and sensed pressure shown as $(P/P_B)_{DESIRED}$. The desired ratio is programmed into an electronic controller as a function of corrected rotor speed. Corrected rotor speed is the rotational speed N of the compressor divided by the square root of θ where θ is the absolute stagnation temperature at the engine inlet divided by a reference absolute temperature (approximately 519 degrees Rankine). The desired ratio might also be made a function, at least in part, of recent transient influences imposed on the engine, such as sudden changes in altitude, airspeed or engine power setting. The controller determines an error E having an actual component and a desired component. The actual component is a function of the actual ratio, $(P/P_B)_{ACTUAL}$ and, in the controller diagram of FIG. 4, is equal to the actual ratio $(P/P_B)_{ACTUAL}$. The desired component is the desired ratio, $(P/P_B)_{DESIRED}$. The controller issues commands to the clearance control system hardware, for example to the valve that regulates admission of cool air to the duct 46, to reduce the error.

Although this invention has been shown and described with reference to a specific embodiment thereof, it will be understood by those skilled in the art that various changes in form and detail may be made without departing from the invention as set forth in the accompanying claims.

I claim:

1. A method for controlling blade tip clearance in a turbine engine, the engine having a flowpath extending therethrough, the method comprising acquiring a nonpulsating pressure signal representative of tip clearance;

sensing a pressure substantially unaffected by tip clearance;

forming an actual ratio of the acquired pressure signal and the sensed pressure;

determining an error having an actual component and a desired component, the actual component being a function of the actual ratio; and commanding a clearance control system to reduce the error.

2. The method of claim 1 wherein the acquired pressure signal is acquired from a non-flowpath site.

3. The method of claim 1 wherein the actual component of the error is a ratio of the acquired pressure signal and the sensed pressure, and the desired component of the error is a desired ratio of an acquired pressure and a sensed pressure.

4. The method of claim 1 wherein the actual component of the error is an estimated actual clearance and the desired component of the error is a desired clearance.

5. The method of claim 1 wherein the acquired pressure signal is acquired from a cavity inboard of a turbine flowpath and the sensed pressure is burner pressure.

6. A system for controlling blade tip clearance in the turbine of a turbine engine having a flowpath extending therethrough, the system comprising:

a first sensor responsive to a nonpulsating first pressure signal representative of tip clearance;

a second sensor responsive to a second pressure signal substantially unaffected by tip clearance;

a controller for a) forming an actual ratio of the first and second pressure signals;

b) determining an error having an actual component and a desired component, the actual component being a function of the actual ratio;

c) reducing the error by issuing commands to change the first pressure signal; and wherein the actual component of the error is an estimated actual clearance and the desired component of the error is a desired clearance.

7. The method of claim 6 wherein the first pressure signal is acquired from a cavity inboard of a turbine flowpath and the second pressure signal is sensed in an engine burner.

* * * * *